United States Patent [19]

Hebert et al.

[11] Patent Number: 4,714,119

[45] Date of Patent: Dec. 22, 1987

[54] APPARATUS FOR HARD ROCK SIDEWALL CORING A BOREHOLE

[75] Inventors: Joel J. Hebert, Houston; Jo-Yu Chuang, Sugar Land, both of Tex.

[73] Assignee: Schlumberger Technology Corporation, Houston, Tex.

[21] Appl. No.: 791,246

[22] Filed: Oct. 25, 1985

[51] Int. Cl.[4] ..... E21B 25/02; E21B 49/06

[52] U.S. Cl. ..... 175/20; 175/58; 175/78

[58] Field of Search ..... 175/20, 77, 58, 73, 175/74, 75, 76, 78, 97, 98, 244, 251, 252

[56] References Cited

U.S. PATENT DOCUMENTS 4,354,558 10/1982 Jageler et al. ..... 175/58
4,396,074 8/1983 Jageler et al. ..... 175/58
4,449,593 5/1984 Jageler et al. ..... 175/58
4,461,360 7/1984 Mount, II ..... 175/58

*Primary Examiner*—Stephen J. Novosad
*Assistant Examiner*—William P. Neuder

[57] ABSTRACT

A core drilling mechanism in an elongate housing is rotated from a vertical storage position to a horizontal operable position. This permits the transport downhole of a drilling mechanism of sufficient longitudinal dimension to drill a core sample of substantial length perpendicular to the borehole sidewall. A fixed slotted plate and hydraulically actuated rotatable drive plate control the motion of the drilling mechanism, which is stored vertically for descent and ascent, and rotated 90-degrees and moved outward for core drilling. After a core sample is drilled, the drilling mechanism is tilted upward to break off the core, and then returned to its vertical storage position.

12 Claims, 12 Drawing Figures

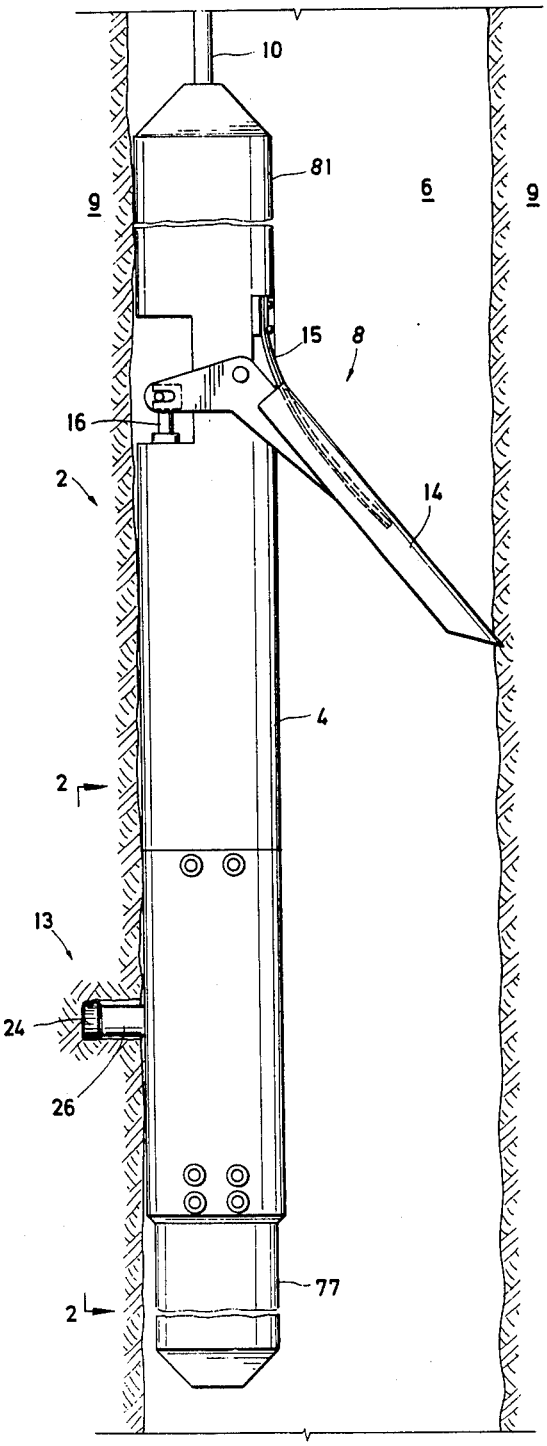
FIG. 1
FIG. 2
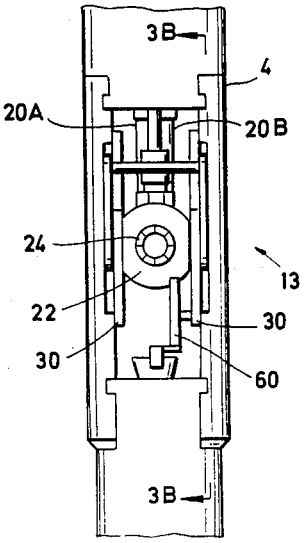

FIG. 3A
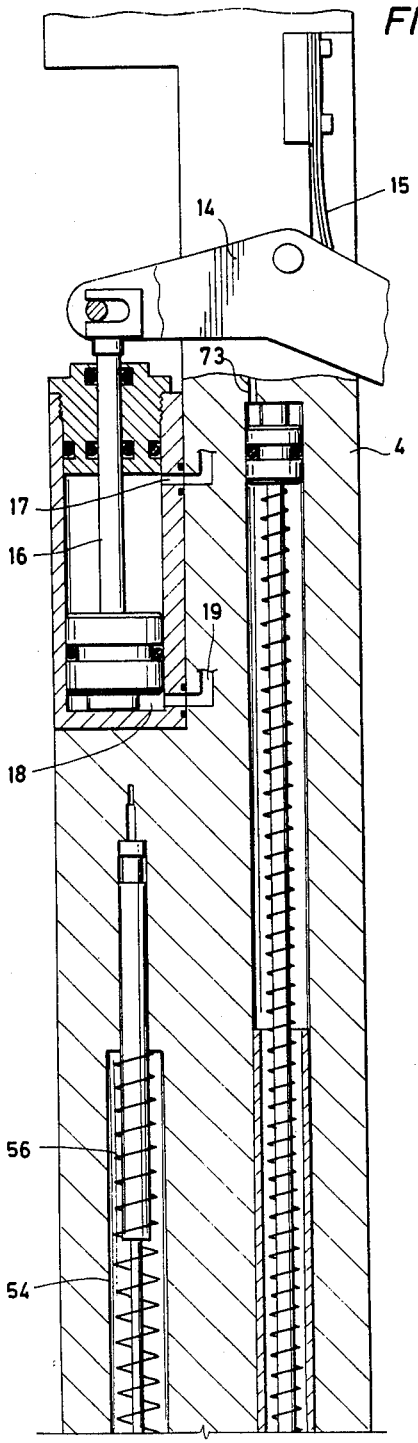
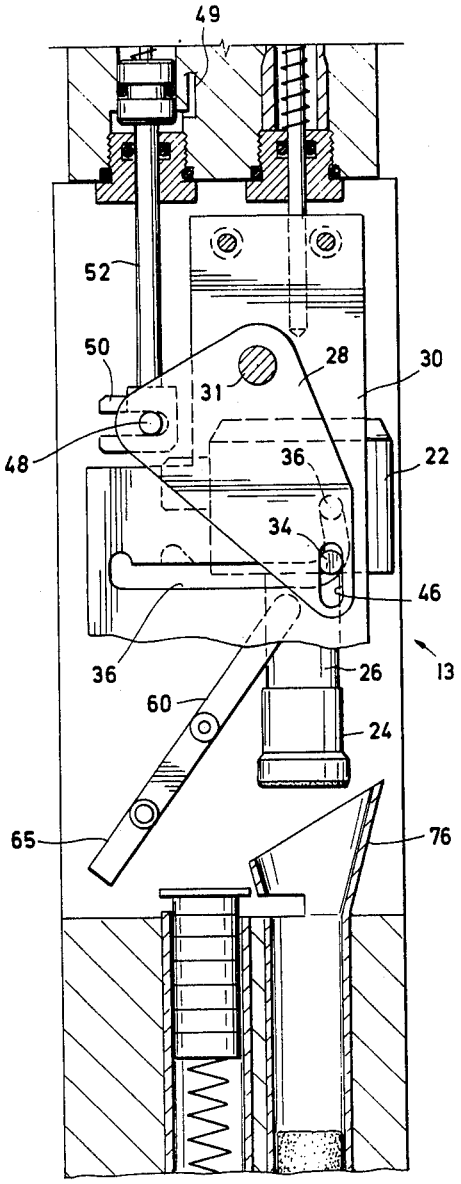
FIG. 3B

FIG. 4
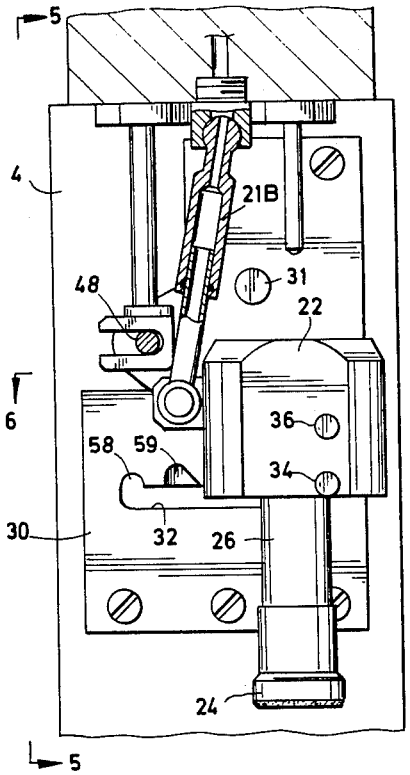
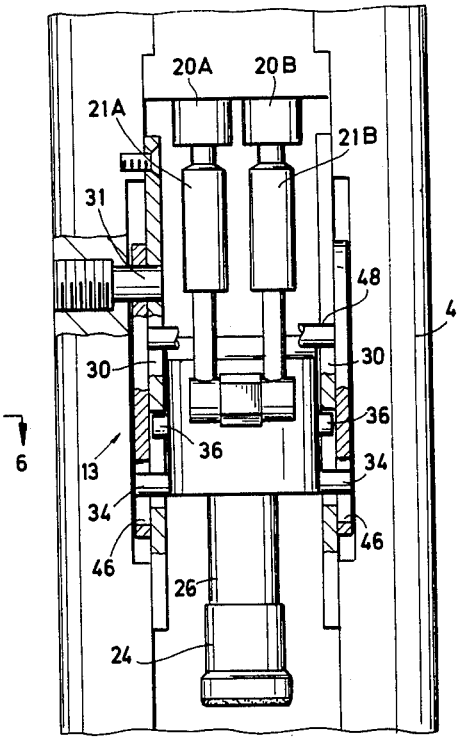
FIG. 5
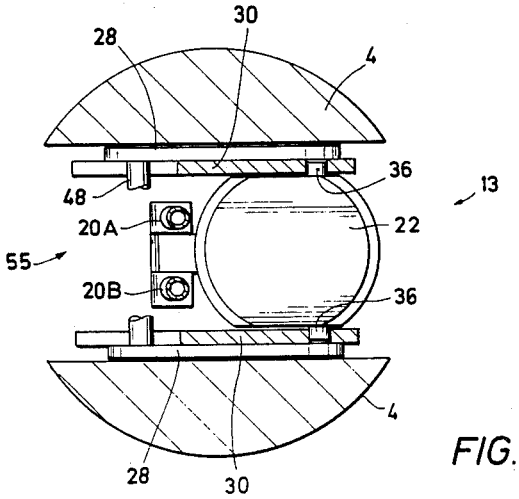
FIG. 6

APPARATUS FOR HARD ROCK SIDEWALL CORING A BOREHOLE

BACKGROUND OF THE INVENTION

In the investigation of earth formations for oil or other hydrocarbons, it is often advantageous to verify mineral composites, porosity and permeability of obtaining samples of the formation from the sidewall of a borehole drilled vertically therethrough. A borehole drilled for oil exploration, however, is usually only a few inches in diameter. BEcause of this size constraint, coring into the sidewall in a perpendicular direction and storing a number of cores is problematical. prior art coring devices have been unable to accomplish both perpendicular coring and storage of an appreciable number of cores, or have been incapable of drilling samples from hard materials in a formation. In addition, the horizontal depth of drilling has been limited by the dimensional constraints which a coring tool must meet.

The typical coring tool includes a drill bit driven by a coring motor. U.S. Pat. No. 4,354,558 issued on Oct. 19, 1982, to Jageler et al discloses a particular design for a coring tool in which the drill bit and coring motor are rotate into an operable position. But, this embodiment of the device taught in this patent cannot drill in a direction perpendicular to the sidewall. This reduces the usefulness of the core sample for analysis, and also reduces the perpendicular distance into the formation from which sample material can be taken. This tool is further limited in the small number of cores which it can store. Core sample storage is an important consideration since a tool with inadequate storage provisions will necessitate several trips down the borehold to obtain the required number of core samples. Such extra trips creates considerable expense, both directly and through lost rig time.

A need has thus arisen for a coring device capable of cutting samples from hard rock in an efficient and reliable manner. Such a device should cut into the sidewall of a borehole in a perpendicular direction to the greatest depth possible, and be capable of storing a large number of cores.

SUMMARY OF THE INVENTION

The present invention provides an apparatus for cutting core samples from the sidewall of a borehole. A core drilling mechanism in an elongate housing is rotated from a vertical storage position to a horizontal operable position. This permits the transport downhole of a drilling mechanism of sufficient longitudinal dimension to drill a core sample of substantial length perpendicular to the borehole sidewall.

In a preferred embodiment of the invention, a fixed slotted plate is used in conjunction with a hydraulically actuated rotatable drive plate to rotate the drilling mechanism, which includes a coring motor, drill bit and core retaining sleeve. The coring motor drives the bit, with a preferably high-volume, medium pressure pump supplying the motive power. The fixed slotted plate and the rotatable plate control the motion of the drilling mechanism, which is stored vertically for descent and ascent, rotated 90-degrees and moved outward for core drilling. After a core sample is drilled, the drilling mechanism is tilted upward to break off the core, and then returned to its vertical storage position. A single guide slot directs the motor in its rotational and translational movement, with the rotatable drive plate transmitting force to a single pin extending from each side of the coring motor into the guide slot. A second pin follows the first to stabilize the position and movement of the motor. This arrangement results in a reliable and smoothly operating device, which requires only a modest amount of power to operate.

A core pusher mechanism is activated when the coring motor is returned to a vertical position after coring to push the core into a core storage chamber. The rotatable plate and the core pusher are driven by hydraulic cylinders along the housing axis, as is an anchoring shoe which secures the apparatus in the desired vertical position.

BRIEF DESCRIPTION OF THE DRAWINGS

FIG. 1 is a side view of a preferred embodiment of the invention in operable position in a borehole;

FIG. 2 is a cross-sectional view taken along lines 2—2 of FIG. 1;

FIGS. 3A and 3B are a cross-sectional view of the FIG. 1 embodiment, with FIG. 3B comprising a lengthwise continuation of FIG. 3A, showing a view taken along lines 3B—3B of FIG. 2;

FIG. 4 is a sectional view, with parts removed of the drilling and drive assemblies of the FIG. 1 embodiment;

FIG. 5 is a cross-sectional view taken along line; 5—5 of FIG. 4;

FIG. 6 is a cross-sectional view taken along line 6—6 of FIG. 4;

DETAILED DESCRIPTION OF A PREFERRED EMBODIMENT

Figure 8:
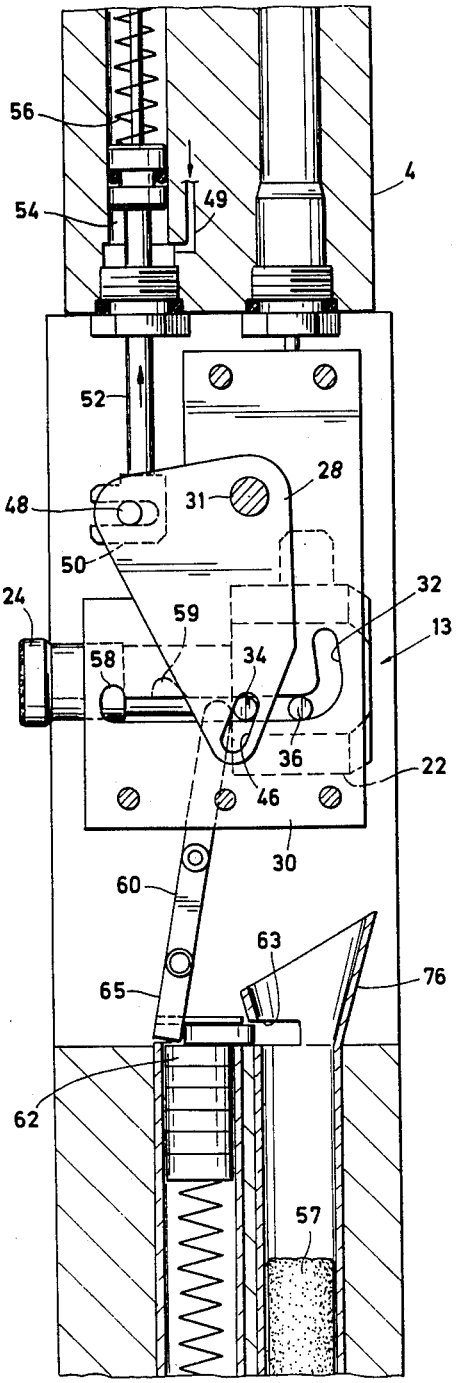
FIGS. 7–10 are cross-sectional views showing the sequence of operation of the FIG. 1 embodiment.

Referring to FIG. 1, a preferred embodiment of a coring tool apparatus 2 according to the present invention includes an elongate housing 4 which contains an anchoring mechanism 8 to secure its position relative to a borehole 6 drilled through a formation 9 and a core drilling mechanism 13 for cutting cores. The housing 4 is adapted for attachment to a wireline 10 or other conveying means to transport the tool vertically within the borehole 6 and connect the apparatus 2 for communication with suitable power sources and above-ground controls. For most coring uses, a housing 4 having an outer diameter of less than 6¼ inches is satisfactory.

As shown in FIGS. 1 and 3A, the anchoring mechanism 8 of a preferred embodiment includes an L-shaped anchoring shoe 14 pivotally attached at its vertex to the housing 4 for movement toward and away from the side of housing 4 opposite the drilling mechanism 13. The shoe 14 lies flush against the housing 4 while the tool 2 is traveling through the borehole. When the tool 2 is at the desired vertical position, the shoe 14 can be pivoted to an extended position by a hydraulic ram 16 coupled thereto. When the ram 16 retracts into its associated cylinder 18, the shoe 14 is extended away from the housing 4 to engage the side of the borehole, holding the drilling mechanism 13 firmly against the formation 9 in the desired vertical position. Extension of the ram 16 from the cylinder 18 retracts the shoe 14 toward the housing 4. A spring 15 mounted between the housing 4 and shoe 14 will automatically retract the shoe 14, should the hydraulic cylinder 16 fail to operate. Any suitable arrangement for pressurizing the cylinder 18 to effect the desired movement of the ram 16 may be used, such as the provision of hydraulic line inlets 17, 19 to both ends of the cylinder 18 as shown in FIG. 3A. Here, as is the case throughout the figures, hydraulic lines are not shown in their entirety for clarity of illustration.

Referring now to FIGS. 2, 3B, and 4–6, the core drilling mechanism 13 includes a hydraulic coring motor 22 which is connected to a hydraulic power supply (not shown) by lines 20A, 20B. The motor 22 has a hollow shaft, from which a drill bit 24 on the end of a core retaining sleeve 26 extends. The drill bit 24 is preferably a diamond bit capable of cutting a core of approximately 1 inch diameter and the sleeve 26 is preferably capable of holding a core two inches in length. To allow the coring motor to fit entirely within the housing 4 in its vertical stowed position, the coring motor 22 has a transverse dimension smaller than the diameter of the housing 4. Drill bits and coring motors suitable for use in a preferred embodiment of the invention are commercially available.

Two pins 34, 36 extend from each side of the coring motor 22 on a line parallel to the axis of the motor. The coring motor 22 is supported by the pins 34, 36 between a pair of vertical plates 30 which are fixedly mounted to the housing 4. Each of these fixed support plates 30 has a preferably J-shaped guide slot 32 in which the pins 34, 36 are engaged. As best shown in FIG. 3B, the J-shaped slot has its longer leg disposed in a horizontal direction, with its shorter leg extending upward therefrom. The horizontal leg extends toward the formation to be cored. The spacing and positioning of the pins 34,36 and the dimensions and shape of the slot 32 are chosen so that, when the rearwardmost pin 36 is at the top of the shorter length, the drill bit points in a generally vertical downward direction, as shown in FIG. 3B. Thus, variations from the illustrated embodiment, such as an L-shaped slot, may fall within the scope of the invention.

Figure 7:
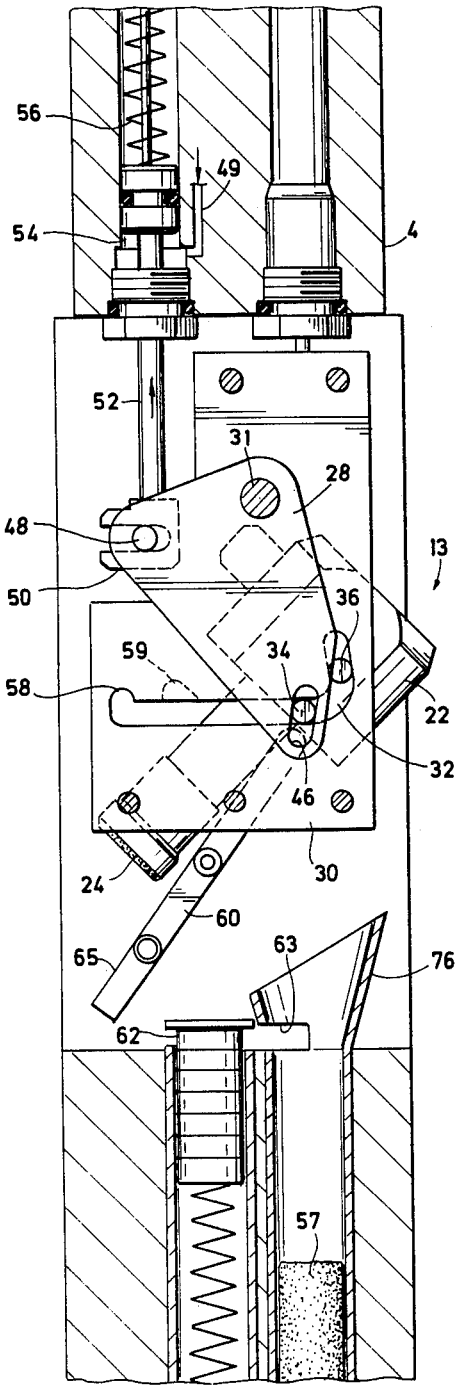

As FIGS. 7 and 8 illustrate, if the pins 34, 36 were driven along the J-shaped slot 32 from its shorter leg to the end of its horizontal leg, the coring motor 22 would be rotated through 90 degrees and pushed forward toward the formation 9. This is accomplished by a drive mechanism which includes a pair of generally triangular drive plates 28, each of which lies between one of the fixed plates 30 and the housing 4. Each of the drive plates 28 is pivoted about a pin 31 near one of its vertices. A slot 46 near a second vertex of the drive plate 28 engages the pin 34 which is forwardmost on the coring motor body. This leading pin 34 is longer than the follower pin 36, to extend through both the J-slot of the fixed plate 30 and this slot 46 on the drive plate 28. A bar 48 extends between the two drive plates near the third vertex of each and is coupled by a yoke 50 at its midpoint to a ram 52 in a hydraulic cylinder 54 which is selectively pressurized by conventional means. The cylinder 54 extends vertically upward in the housing 4, and preferably has a pressure inlet 49 for connection to a hydraulic line at its lower end.

Referring to FIGS. 3B, 7 and 8, as the ram 52 retracts into the cylinder 54, the drive plate 28, which acts as a cam, is pivoted about pin 31, pushing the leading pin 34 along the J-shaped slot 32 to rotate the coring motor 22 to a horizontal position. Sliding fittings 21A, 21B (shown in FIG. 4) on the inlets of the lines 20A, 20B to the motor 22 accommodate this motion. After the drilling mechanism 13 has been rotated 90 degrees to the horizontal position by retraction of the ram 52 into the hydraulic cylinder 54, further upward movement of the ram 52 causes forward movement of the drilling mechanism 13 outward from an opening 55 in the housing (shown in FIGS. 2 and 6) into engagement with the sidewall of the borehole 6. At or prior to reaching the horizontal position, the shaft of the coring motor is rotated, preferably at approximately 2000 rpm, by a system described below, causing the drill bit 24 to drill a core 57 as the pins 34, 36 move toward the forwardmost end of the guide slot 32.

Figure 9:
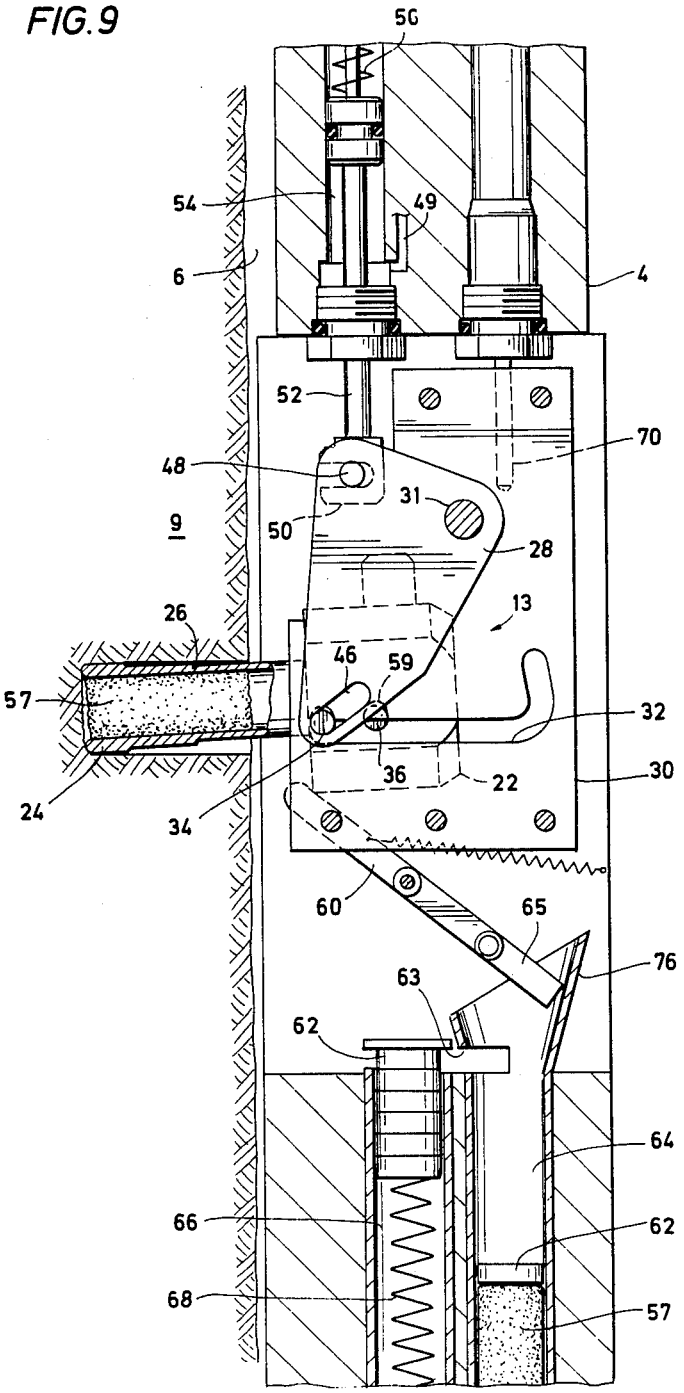

Referring now to FIG. 9, the pins 34 and 36 move into position directly under a pair of vertical notches 58 and 59 extending upward from the horizontal leg of the J-slot 32, when the motor reaches the end of the slot 32. Then, continued upward movement of the hydraulic ram 52 generates a lifting force on the leading pin 34 so that the pins 34 and 36 are raised up into notches 58 and 59 to tilt the drilling mechanism 13. The drill bit 24 breaks off the core 57 by levering the core at its front edge. To prevent the longer, leading pin 34 from jamming in the rearward notch 59 and obstructing forward movement of the coring motor 22, this notch 59 does not extend through the full thickness of the plate 30, but only far enough to accommodate the follower pin 36.

Figure 10:
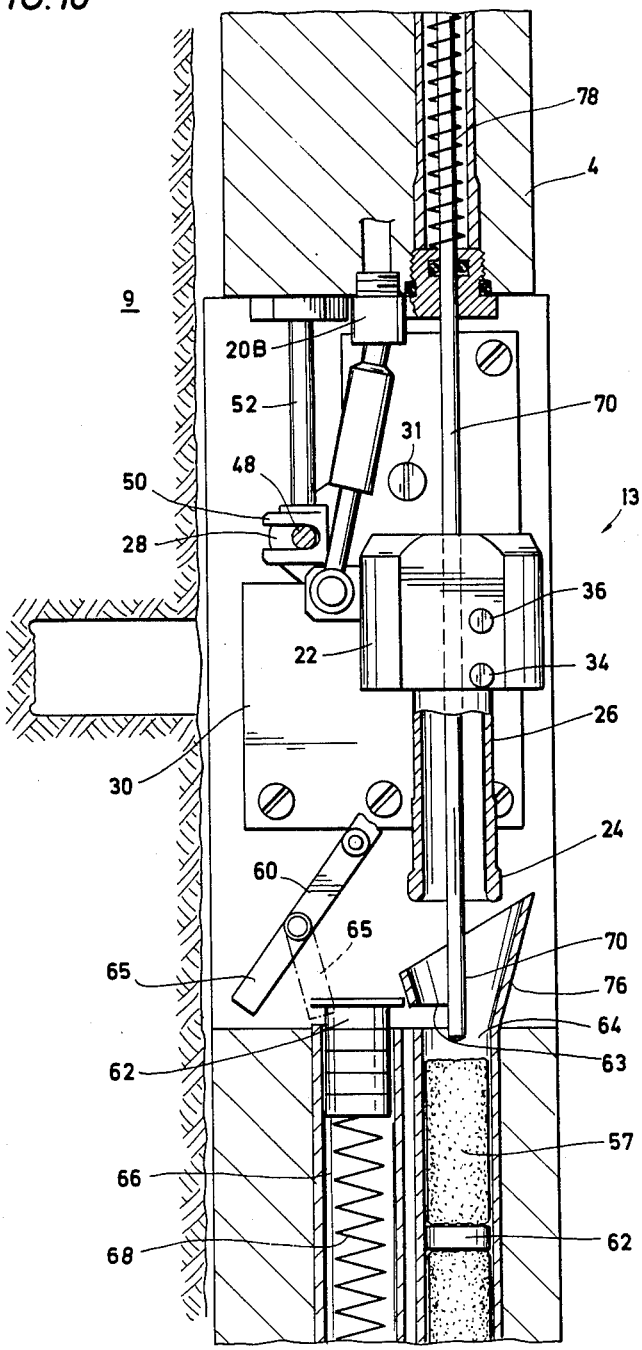

Referring now to FIG. 10, after the core 57 has been broken off, the drilling mechanism 13 is retracted and returned to its vertical position by extension of the ram 52 as the cylinder 54 is pressurized. A return spring 56 inside the cylinder 54 ensures that the drilling mechanism 13 will be retracted even if the hydraulic system fails. After the drilling mechanism 13 reaches the vertical position, a core pusher rod 70 is extended through the drilling mechanism 13 by a piston 72 in a vertical hydraulic cylinder 74, to push the core 57 out of the core retaining sleeve 26 into a funnel-like guide 76 which conducts the core into a cylindrical core storage chamber 64. When this is accomplished, the anchoring shoe 14 is retracted to allow the tool 2 to travel through the borehole 6 once more.

The core storage chamber 64 is vertically disposed within the lower portion 77 of the housing 4 (shown in FIG. 1) so that the diameter of the borehole 6 presents no constraint to the number of core samples which may be stored in the apparatus 2. The gravity feed operation of the guide 76 ensures the unhampered travel of core samples into the storage chamber 64. A spring 78 in the cylinder 74 biases the piston 72 upward to remove the core pusher rod 70 from the drilling mechanism 13, should the hydraulic system fail to do so.

Referring now to FIGS. 2, 3B, 7–10, while the coring motor 22 moves forward to drill the core, its leading edge pushes a kicker rod 60 which is pivoted to the housing 4 below the drilling mechanism. A kicker foot 65 extends transversely from the rod 60 to kick a core marker disk 62 through a guide slot 63 in the funnel 76 into the core storage chamber 64 to separate and mark successively drilled cores. The core marker disks 62, which can be manufactured of any suitable material which will not deteriorate under typical borehole conditions or damage the core samples, are stacked and spring-biased upward in a core marker barrel 66 adjacent to storage chamber 64. A spring 68 (shown in FIG. 9) mounted between the housing and kicker rod 60 biases the kicker rod 60 toward its original position. The foot 66 is hinged to bend as it passes over the core markers 62 as the kicker rod returns, after which it is straightened by a torsional spring (not shown).

Figure 11:
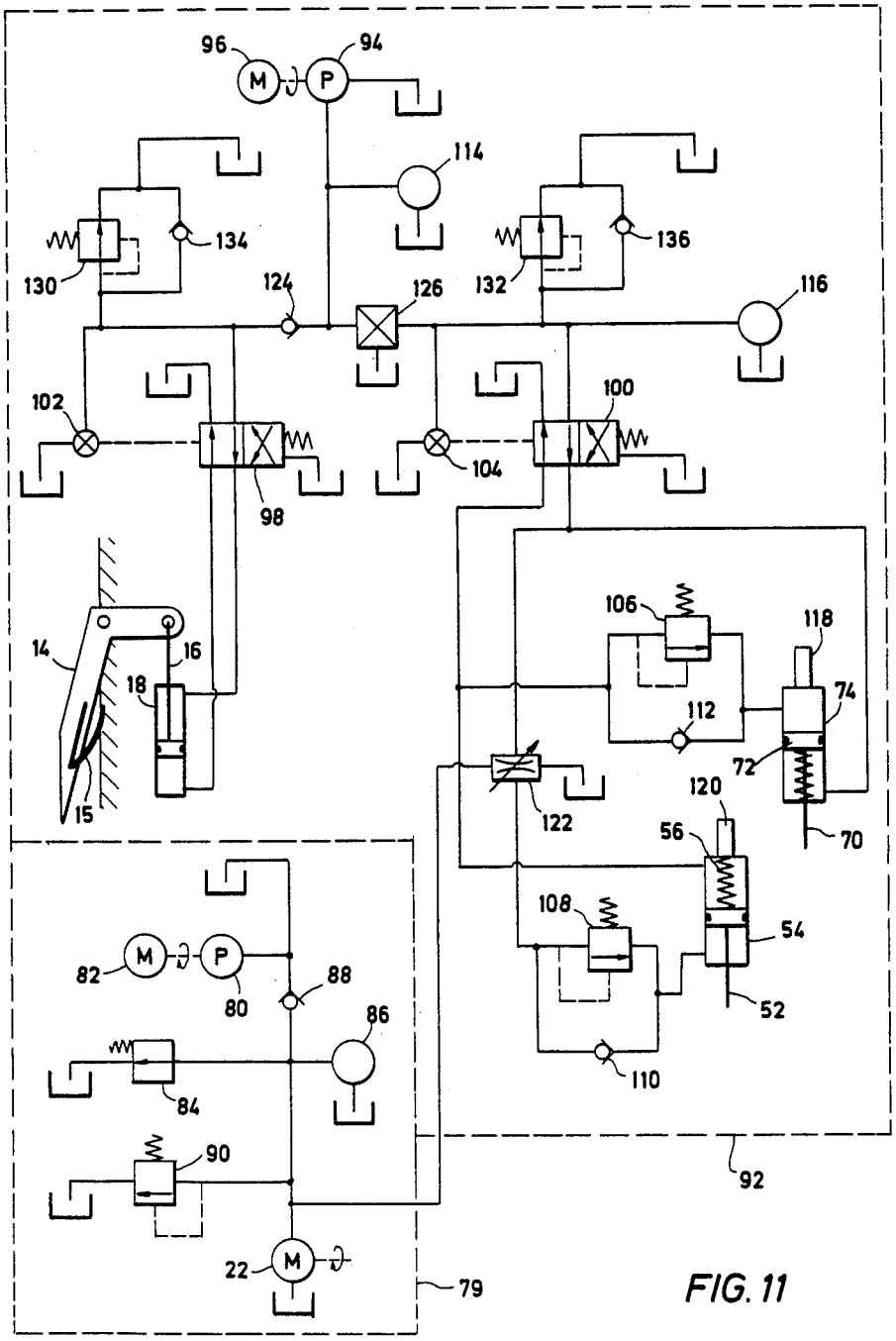
FIG. 11 is a diagram of the hydraulics of the FIG. 1 embodiment.

Referring now to FIG. 11, the coring motor hydraulic circuit 79 of a preferred embodiment directly dirves the coring motor 22 with a pump 80 powered by an electric motor 82. A pump operable at approximately 4.5 gallons per minute and powered by a 1.5 hp electric motor has been found suitable for this purpose. A velocity fuse 84 which automatically opens when the pump 80 stops permits no-load starting of the electric motor 82. Preferably, the fuse will be set for a 3 gallons/min. limit. Status of the coring motor hydraulic circuit 79 is indicated by a pressure transducer 86 at the pump outlet. A check valve 88 is used to prevent the back surge damaging the pump. A relief valve 90 is used to prevent excess pressure in the coring motor 22. The coring motor hydraulic circuit 79 is preferably housed in the upper portion 81 of the housing 4, which is shown in FIG. 1.

Still referring to FIG. 11, the positioning drive system hydraulic circuit 92, which likewise is preferably housed in the upper portion 81 of the housing 4, drives a downhole pump 94 with a preferably 0.1 hp motor 96, and also drives the anchoring shoe ram 16, core pusher piston 72, and drive plate ram 52. The positioning system hydraulic circuit 92 operates continuously during a single coring operation, and is turned off only during travel of the apparatus through the borehole.

The positioning system hydraulic circuit 92 is divided into two similar branches, each of which is controlled by a pilot-operated, two-position, four-way control valve 98, 100. The control valves direct flow to the hydraulic cylinders in accordance with commands sent from an above-ground source via a wireline 10 or other suitable means to the 3-way solenoid pilot valves 102, 104. The control valves 98, 100 and solenoid valves 102, 104 provide an economic use of space, which is an important consideration in downhole tools, and also provide a fast-acting downhole hydraulic control system.

Relief valve/check valve pairs, 106, 108, and 100, 112 control the sequence for retracting the core pusher rod 70 completely before the rotatable drive plate 28 moves during the coring sequence, and for retracting the motor 22 back to vertical position before the core pusher rod descends during the coring motor retracting sequence.

Status is indicated by two pressure transducers 114, 116, a limit switch 118 to indicate the nested position of the core pusher piston and a linear potentiometer 120 to indicate the position of the piston associated with the rotating drive plate ram 52.

A feedback flow controller 122 controls weight-on-bit by using back pressure in the coring motor circuit 79 to control a needle valve in the line to the drive plate piston. As resisting torque from the formation face increases, so does back pressure, thus slowing down the drive plate piston to slow the forward movement of the drill bit 24. Because of this, the tool 2 is capable of drilling through hard rock in a reliable and efficient manner.

Check valve 124 and sequence valve 126 are used to keep pressure on the piston in shoe cylinder 18 when control valve 100 is activated and the pressure drops in part of the system. The sequence valve 126 makes sure the shoe 14 stand firmly on the formation before the core pusher rod 70 and drive plate 28 move.

Relief valves 130, 132 protect the system from overpressure, and check valves 134, 136 make up line oil when a power failure occurs and the tool automatically retracts.

In operation, the tool 2 is lowered into the borehole 6 on a wireline 10, with the anchoring shoe 14 held flush against the housing 4. When the tool 2 reaches the desired depth, a signal from above ground is carried on the wireline to the first solenoid pilot valve 102, which causes the first control valve 98 to direct flow to the anchoring choe cylinder 18 so as to extend the shoe 14 outward to hold the tool 2 in the desired position against the formation. Signals to the second solenoid pilot 104 result in the second control valve 100 directing flow to the drive plate cylinder 54 to rotate the coring motor 22 and move it toward the formation face. As this occurs, the coring motor 22 is driven by the pump 80. Forward speed of the coring motor 22 as it cuts a core 57 is controlled by the feedback flow controller 122 in the above described manner. When the core 57 is broken off, the relief valves 106, 108 and check valves 110, 112 control flow to cylinders 54 and 74 to retract the motor 22 to its vertical position and extend the core pusher rod 70 therethrough to dislodge the core 57 into the core storage barrel.

Although the invention has been described with respect to a particular embodiment used in a particular environment, this has been done for illustrative purposes only and is not to be construed as a limitation on the scope of the invention.

What is claimed is:

1. A device for cutting a core from the sidewall of a borehole comprising:

an elongated housing lowerable into the borehole;

means for anchoring said housing at a desired position in the borehole;

at least one guide plate fixedly mounted inside said housing in a generally vertical position, said guide plate having therein a J-shaped slot with an elongate leg thereof disposed in a generally horizontal position and a shorter leg extending upward therefrom; core drilling means;

first and second pins extending from the side of said drilling means into said J-shaped slot of said at least one guide plate, and arranged in a line parallel to an axis of said drilling means; and drive means for driving said first pin along said J-shaped slot for pivoting said drilling means between a substantially vertical position and a substantially horizontal position, said drive means including a drive plate pivotally mounted to said housing, means for coupling said drilling means to said drive plate for pivotal movement therewith and means for pivotally moving said drive plate to drive said first pin along said J-shaped slot.

2. The apparatus of claim 1 wherein said pivotally moving means includes a hydraulically actuated ram coupled to said drive plate to pivot said drive plate in such a way so as to drive said pins along said J-shaped slot.

3. The apparatus of claim 2 further comprising means for controlling the speed of movement of said drive plate in response to pressure exerted on the forward end of said drilling means.

4. The apparatus of claim 2 wherein said drilling means includes a drill bit, and a coring motor for rotating said drill bit, said coring motor having a hollow shaft, and further including a vertically disposed hydraulic ram extendable through said hollow shaft to dislodge a core from said drill bit when said drilling means is in its vertical position.

5. The apparatus of claim 4 further comprising a chamber for storing said dislodged cores, said chamber extending in a vertical direction below said ram.

6. An apparatus for cutting and collecting core samples from a sidewall of an earth formation surrounding a borehold, comprising:

housing means having an outer dimension which is sufficiently small so as to allow travel of said housing through the borehole;

means for drilling a core, said drilling means having a forward end for cutting into the formation;

means for supporting said drilling means within said housing for movement between a first position in which said drilling means is in an operable core drilling position with the forward end thereof in contact with the formation and a second position in which said drilling means is rotated ninety degrees from said first operable position and said drilling means is contained within the cross-sectional envelope defined by said housing, said supporting means including a pair of plates mounted to said housing and having formed therein a slot having a first horizontal portion and a second portion extending generally upwardly therefrom, and a first pin extending from the sides of said drilling means and engaged in said slot; and means for moving said drilling means between said first and second positions and including a drive plate pivotally attached to said housing and coupled to said first pin, and hydraulic actuating means for pivoting said drive plate including a hydraulic cylinder, means for coupling said hydraulic cylinder to said drive plate and control means for controlling the pressurization of said hysraulic cylinder.

7. The apparatus of claim 6 wherein said control means includes means for slowing the pressurization of said hydraulic cylinder in response to resistance exerted on said drilling means by said formation.

8. The apparatus of claim 7 wherein said drilling means includes a hydraulically powered coring motor, a drill bit rotatable by said coring motor, and means for supplying hydraulic power to said motor, and wherein said slowing means includes means for controlling pressure supplied to said hydraulic cylinder in response to backup pressure in said hydraulic power supply means.

9. The apparatus of claim 7 wherein said drilling means includes a drill bit and a motor having a hollow shaft for rotating said drill bit, and further including a pusher rod extendable through said hollow shaft of said motor for dislodging the core therefrom.

10. The apparatus of claim 9 further including vertically disposed storage means for storing said dislodged core, and gravity feed means for conducting said dislodged core from said drill bit to said storage means.

11. The apparatus of claim 10 further comprising means for indicating the successive deposit of cores in said storage means.

12. The apparatus of claim 11 wherein said indicating means includes a plurality of disks stored in proximity to said storage means, and means for moving a disk from said disk storage means to said core storage means after a core is deposited in said core storage means.

* * * * *